US010865092B1

(12) United States Patent
Fitt et al.

(10) Patent No.: US 10,865,092 B1
(45) Date of Patent: Dec. 15, 2020

(54) MODULAR BEVERAGE-DISPENSING ASSEMBLY FOR A REFRIGERATOR APPLIANCE

(71) Applicant: Haier US Appliance Solutions, Inc., Wilmington, DE (US)

(72) Inventors: Tyler Fitt, Louisville, KY (US); Steven Fox, Louisville, KY (US); Jacob Wells, Louisville, KY (US); Isabella Mari Cuasay, Louisville, KY (US); Griffin Maxwell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/532,650

(22) Filed: Aug. 6, 2019

(51) Int. Cl.

| | |
|---|---|
| ***B67D 1/08*** | (2006.01) |
| ***F25D 23/12*** | (2006.01) |
| ***B67D 1/00*** | (2006.01) |
| ***F25D 23/02*** | (2006.01) |

(52) U.S. Cl.
CPC ..... *B67D 1/0801* (2013.01); *B67D 1/0057* (2013.01); *B67D 1/0081* (2013.01); *B67D 1/0857* (2013.01); *F25D 23/028* (2013.01); *F25D 23/126* (2013.01); *B67D 2001/0092* (2013.01); *B67D 2001/0094* (2013.01); *B67D 2001/0095* (2013.01); *B67D 2210/00036* (2013.01)

(58) Field of Classification Search
CPC .. B67D 1/0801; B67D 1/0057; B67D 1/0081; B67D 1/0857; B67D 2001/0092; B67D 2001/0094; B67D 2001/0095; B67D 2210/00036; F25D 23/028; F25D 23/126
USPC ..... 222/129
See application file for complete search history.

(56) References Cited

U.S. PATENT DOCUMENTS

| | | | | |
|---|---|---|---|---|
| 4,350,267 | A | 9/1982 | Nelson | |
| 5,096,095 | A | 3/1992 | Burton | |
| 5,791,523 | A | 8/1998 | Oh | |
| 5,909,825 | A * | 6/1999 | Lydford | B67D 1/1245 222/67 |
| 6,896,159 | B2 * | 5/2005 | Crisp, III et al. | B67D 1/08 222/146.6 |
| 7,007,822 | B2 * | 3/2006 | Forshey et al. | B01F 15/0266 222/53 |
| 7,083,071 | B1 | 8/2006 | Crisp, III et al. | |
| 7,997,448 | B1 | 8/2011 | Leyva | |
| 10,077,183 | B2 | 2/2018 | McMahan et al. | |
| 2003/0192920 | A1 * | 10/2003 | Forshey et al. | B67D 7/74 222/504 |
| 2012/0269945 | A1 * | 10/2012 | Wijnen et al. | A23C 9/1307 426/474 |
| 2013/0325171 | A1 * | 12/2013 | Crisp, III | G06F 17/00 700/236 |

* cited by examiner

*Primary Examiner* — Patrick M. Buechner
*Assistant Examiner* — Michael J. Melaragno
(74) *Attorney, Agent, or Firm* — Dority & Manning, P.A.

(57) ABSTRACT

A modular beverage-dispensing assembly, as provided herein, may include a housing, a compressed gas tank mounted to the housing, and a plurality of discrete beverage containers, and a multipath gas valve or multipath liquid valve for dispensing a liquid from one or more of the beverage containers.

20 Claims, 6 Drawing Sheets

MODULAR BEVERAGE-DISPENSING ASSEMBLY FOR A REFRIGERATOR APPLIANCE

FIELD OF THE INVENTION

The present subject matter relates generally to self-contained modular assemblies that can be received within a refrigerator appliance and selectively dispense multiple beverages.

BACKGROUND OF THE INVENTION

Recently, consumers have shown an increasing desire for a wide range of beverages, such as craft beers, coffees, small-batch spirits, or wines. In particular, consumers have sought to enjoy such beverages at home, while socializing, and outdoors. Often, these beverages must be stored in relatively large containers that are designed to hold multiple servings of a single beverage, such as a growler or wine bottle. This presents several problems, though. In particular, it can be difficult to transport or selectively dispense multiple beverages (i.e., different types of beverages). These issues may be magnified if the beverages must be stored (or preferably served) at a relatively low (i.e., refrigerated) temperature, such as below sixty degrees Fahrenheit.

Existing systems for dispensing liquids or beverages, such as from a refrigerator, fail to adequately address these issues. For example, most existing refrigerator appliances are only configured to dispense water. Other beverages must generally be stored in pitchers or bottles, and cannot be selectively dispensed directly from the refrigerator appliance. The risk of spilling a beverage stored within the refrigerator appliance is still high. Moreover, it remains difficult to dispense a specific amount of a beverage. Some refrigerator appliances can create single servings of beverages other than water (e.g., coffee). Even these, however, are generally not portable and do not permit multiple servings to be dispensed on command.

As a result, further improvements to dispensing assemblies are necessary to address one or more of the above-identified issues. In particular, it would be advantageous to have a portable, self-contained assembly for dispensing multiple discrete beverages on demand, while preventing the risk of accidentally spilling or dispensing an incorrect amount of a beverage.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a modular beverage-dispensing assembly is provided. The modular beverage-dispensing assembly may include a housing, a compressed gas tank mounted to the housing, and a plurality of discrete beverage containers, and a multipath gas valve. The plurality of discrete beverage containers may be supported on the housing. The multipath gas valve may be downstream from the compressed gas tank. The multipath gas valve may be in selective upstream fluid communication with the plurality of discrete beverage containers to selectively direct a compressed gas from the compressed gas tank to one beverage container of the plurality of discrete beverage containers.

In another exemplary aspect of the present disclosure, a modular beverage-dispensing assembly is provided. The modular beverage-dispensing assembly may include a housing, a compressed gas tank mounted to the housing, and a plurality of discrete beverage containers, a multipath liquid valve, and an outlet nozzle. The plurality of discrete beverage containers may be supported on the housing. The multipath liquid valve may be in selective downstream fluid communication with each beverage container of the plurality of discrete beverage containers to selectively direct a liquid from one beverage container of the plurality of discrete beverage containers. The outlet nozzle may be downstream from the multipath liquid valve to dispense a liquid received therefrom.

In yet another exemplary aspect of the present disclosure, the refrigerator appliance is provided. The refrigerator may include a cabinet, a door, and a modular beverage-dispensing assembly. The cabinet may define a chilled chamber. The door may be attached to the cabinet to selectively restrict access to the chilled chamber. The modular beverage-dispensing assembly may be selectively received within the chilled chamber. The modular beverage-dispensing assembly may include a housing, a compressed gas tank mounted to the housing, and a plurality of discrete beverage containers, a multipath gas valve, a multipath liquid valve, and an outlet nozzle. The plurality of discrete beverage containers may be supported on the housing. The multipath gas valve may be downstream from the compressed gas tank. The multipath gas valve may be in selective upstream fluid communication with the plurality of discrete beverage containers to selectively direct a compressed gas from the compressed gas tank to one beverage container of the plurality of discrete beverage containers. The multipath liquid valve may be in selective downstream fluid communication with each beverage container of the plurality of discrete beverage containers to selectively direct a liquid from one beverage container of the plurality of discrete beverage containers. The outlet nozzle may be downstream from the multipath liquid valve to dispense a liquid received therefrom.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
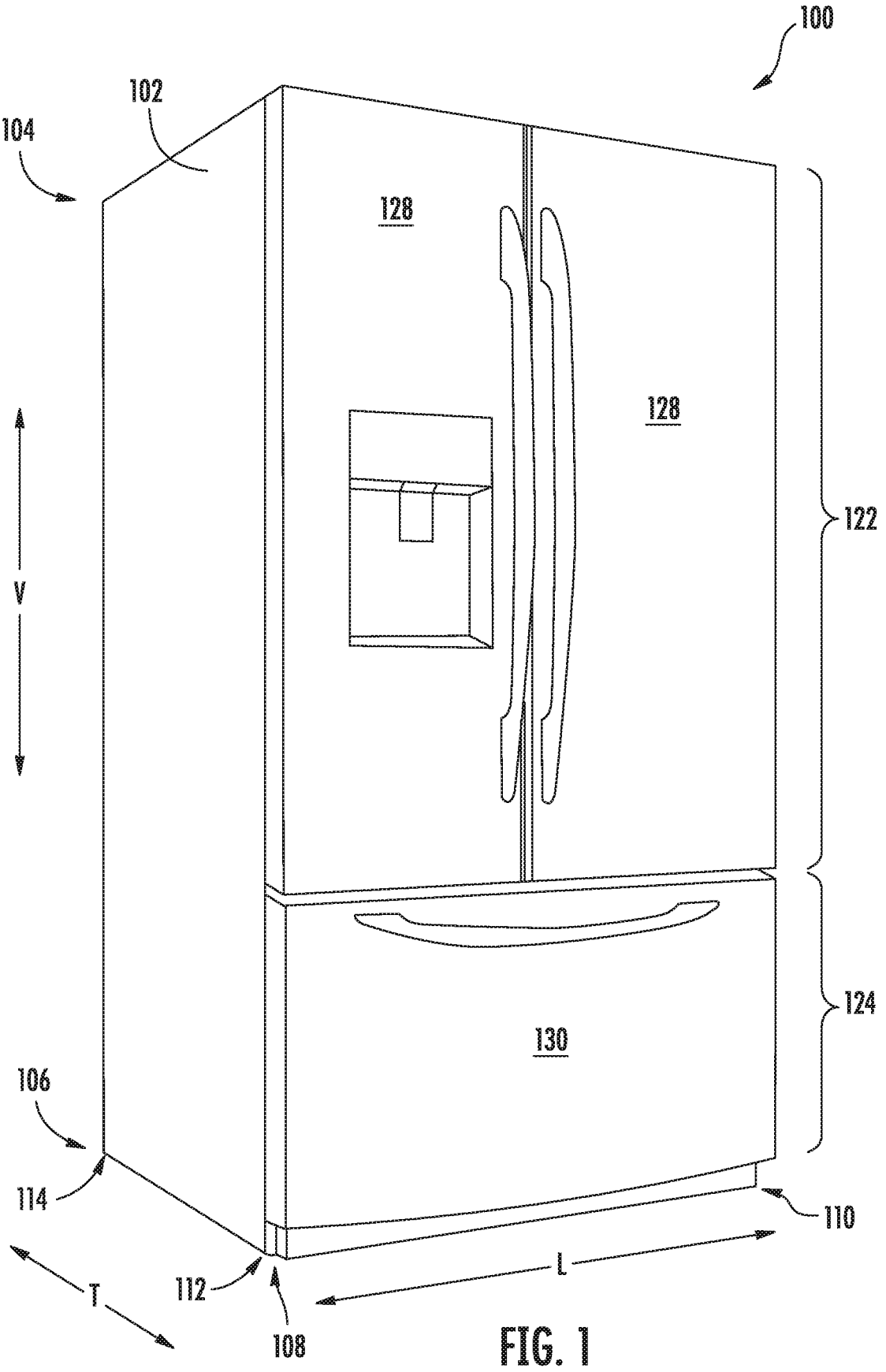
FIG. 1 provides a perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
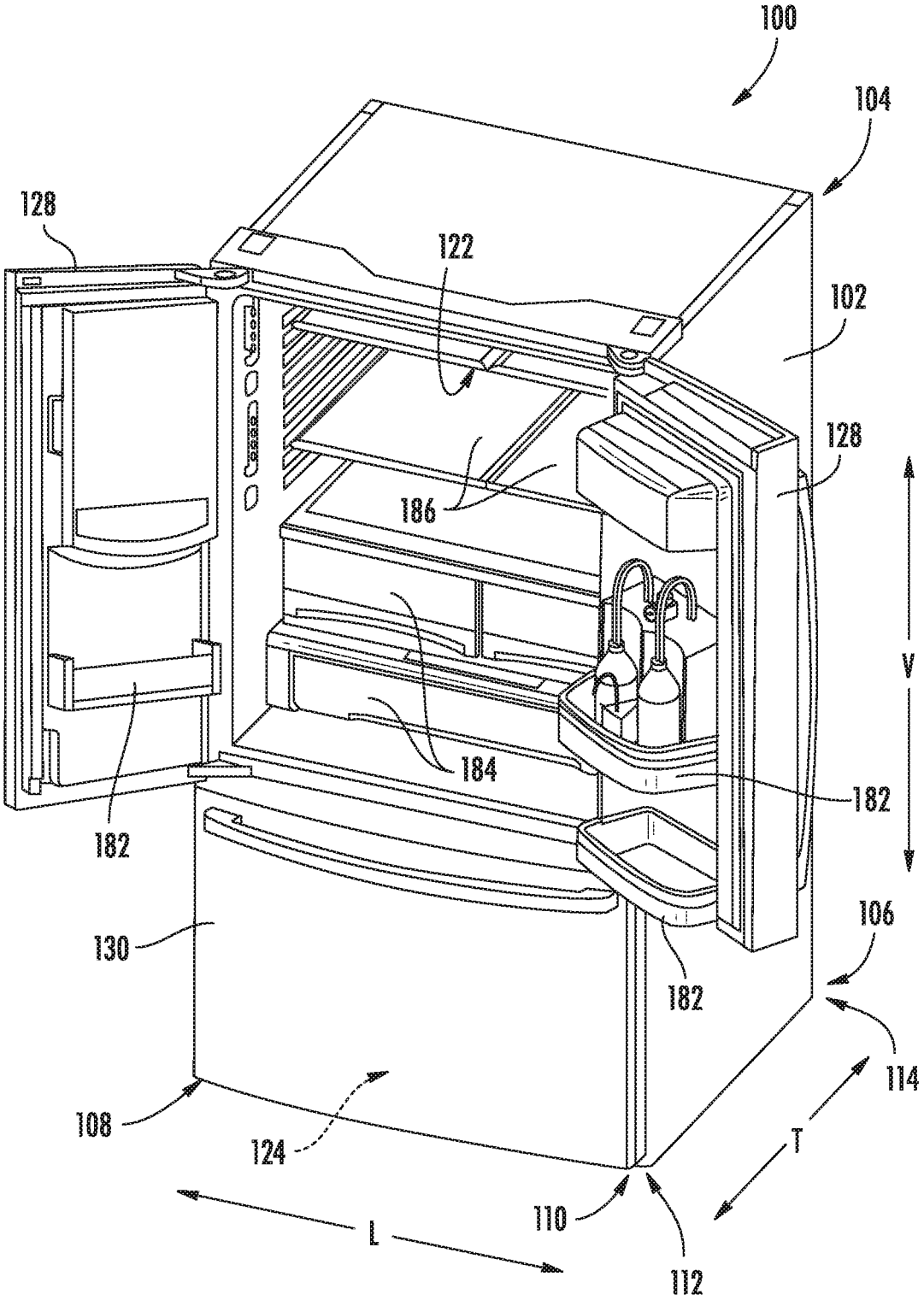
FIG. 2 provides a perspective view the exemplary refrigerator appliance of FIG. 1, wherein multiple doors are shown in an open position, revealing a modular beverage-dispensing assembly.
Figure 3:
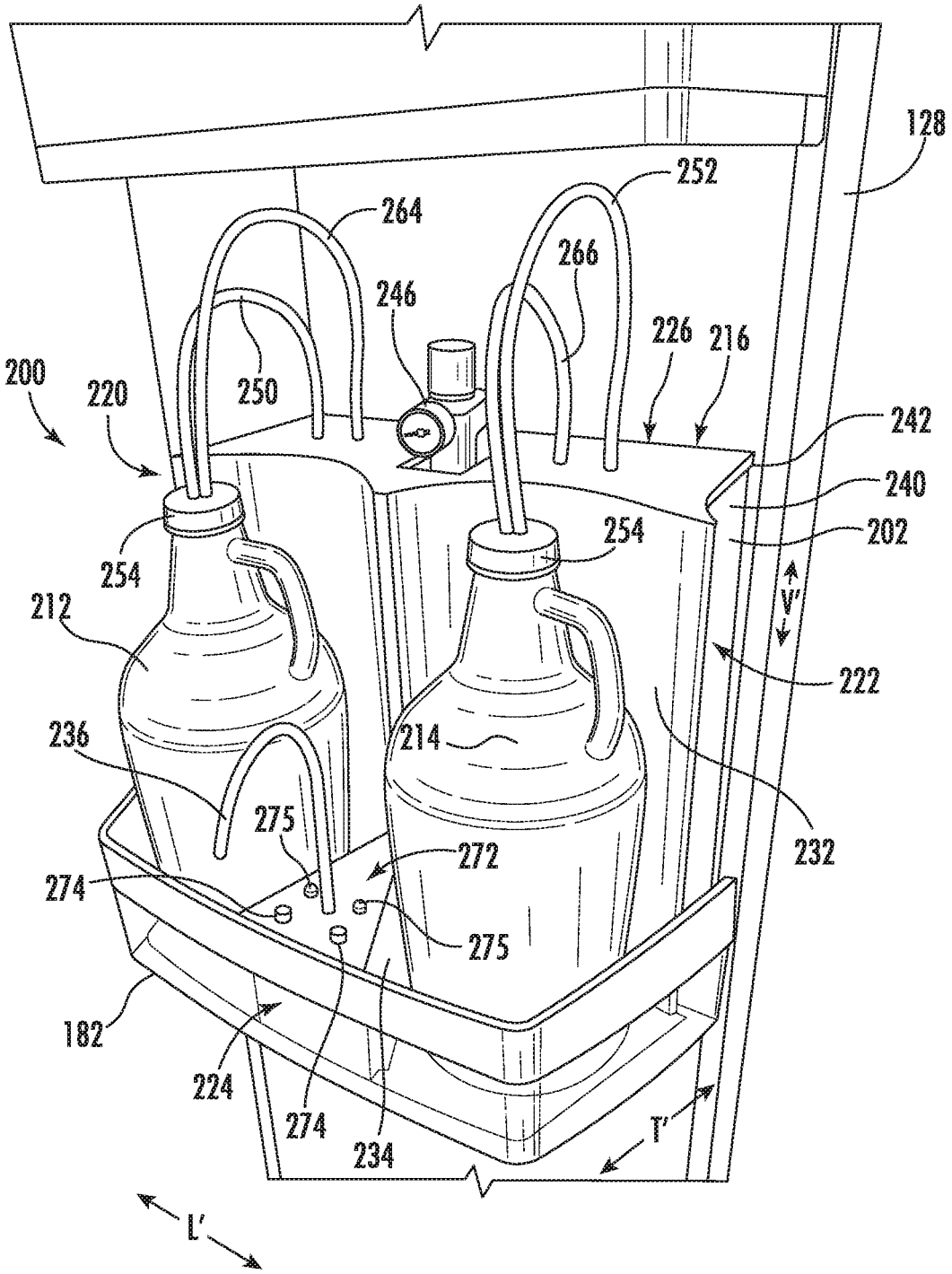
FIG. 3 provides a perspective view of a modular beverage-dispensing assembly within a refrigerator door according to exemplary embodiments of the present disclosure.
Figure 4:
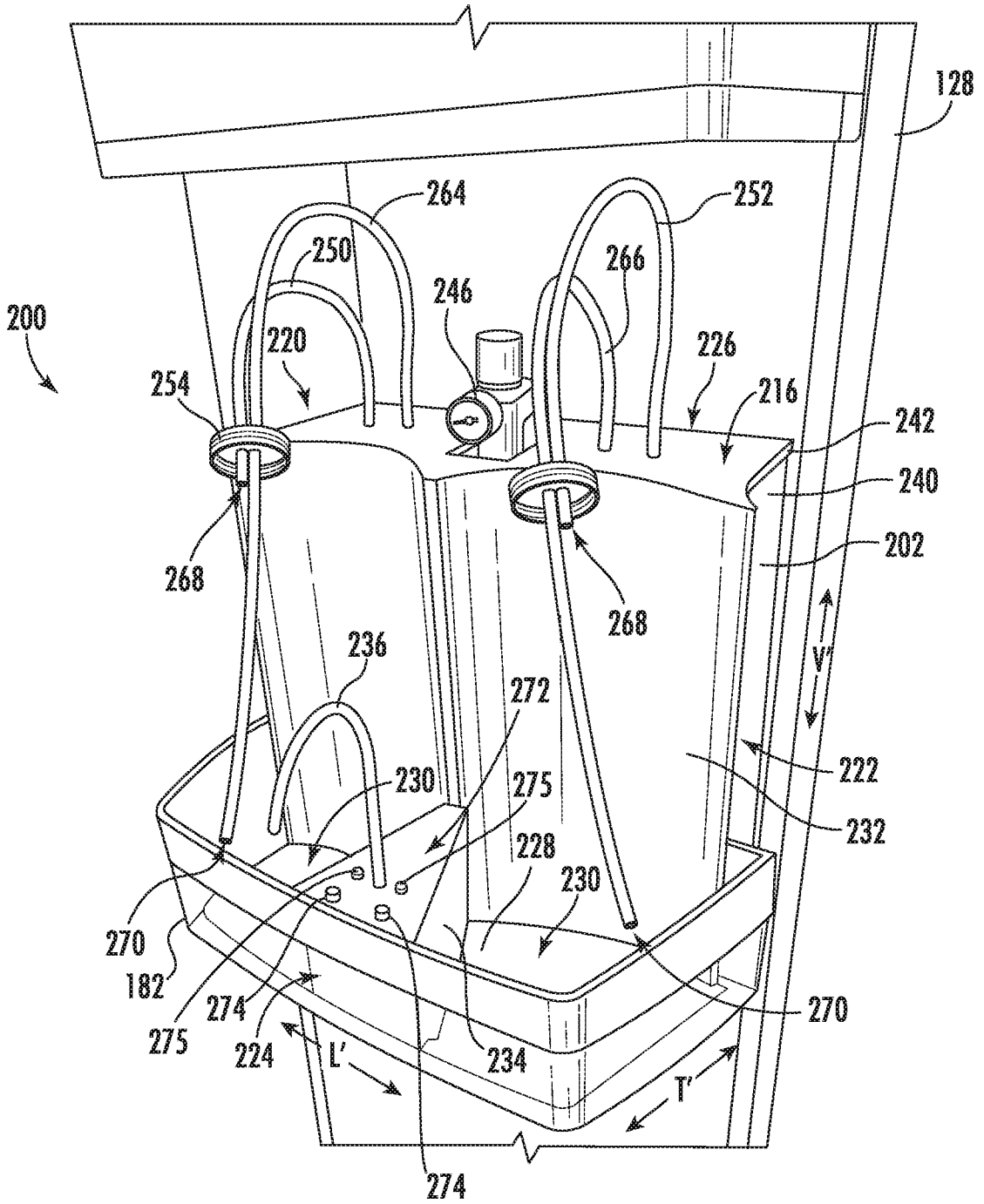
FIG. 4 provides a perspective view of a modular beverage-dispensing assembly within a refrigerator door, wherein multiple beverage containers have been removed.
Figure 5:
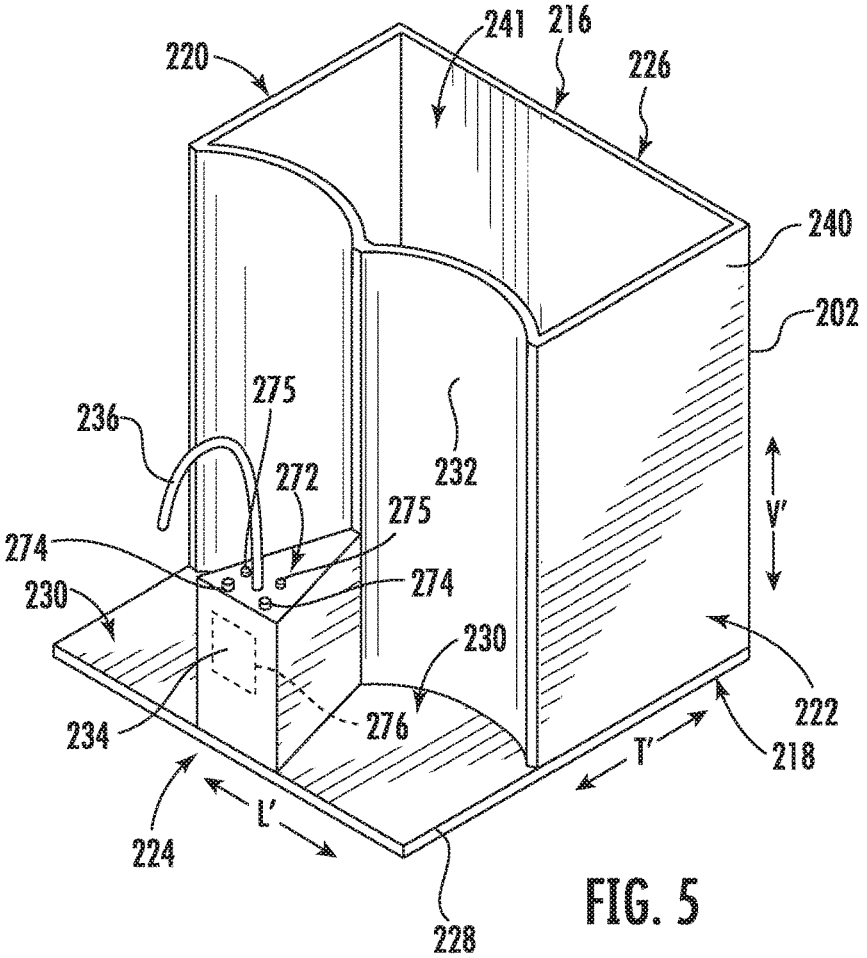
FIG. 5 provides a perspective view of a modular beverage-dispensing assembly according to exemplary embodiments of the present disclosure.
Figure 6:
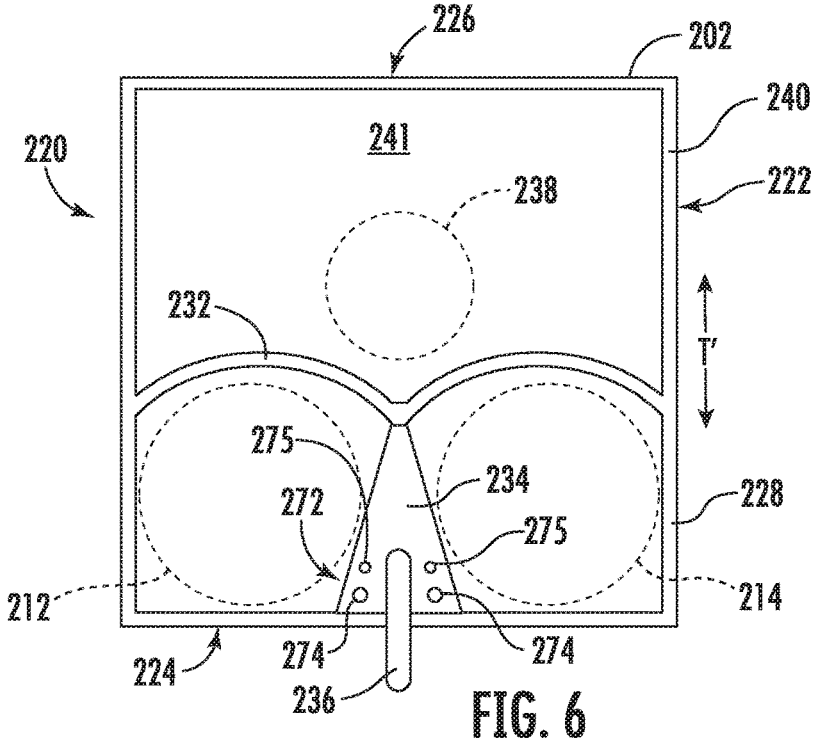
FIG. 6 provides a top plan view of a modular beverage-dispensing assembly according to exemplary embodiments of the present disclosure.
Figure 7:
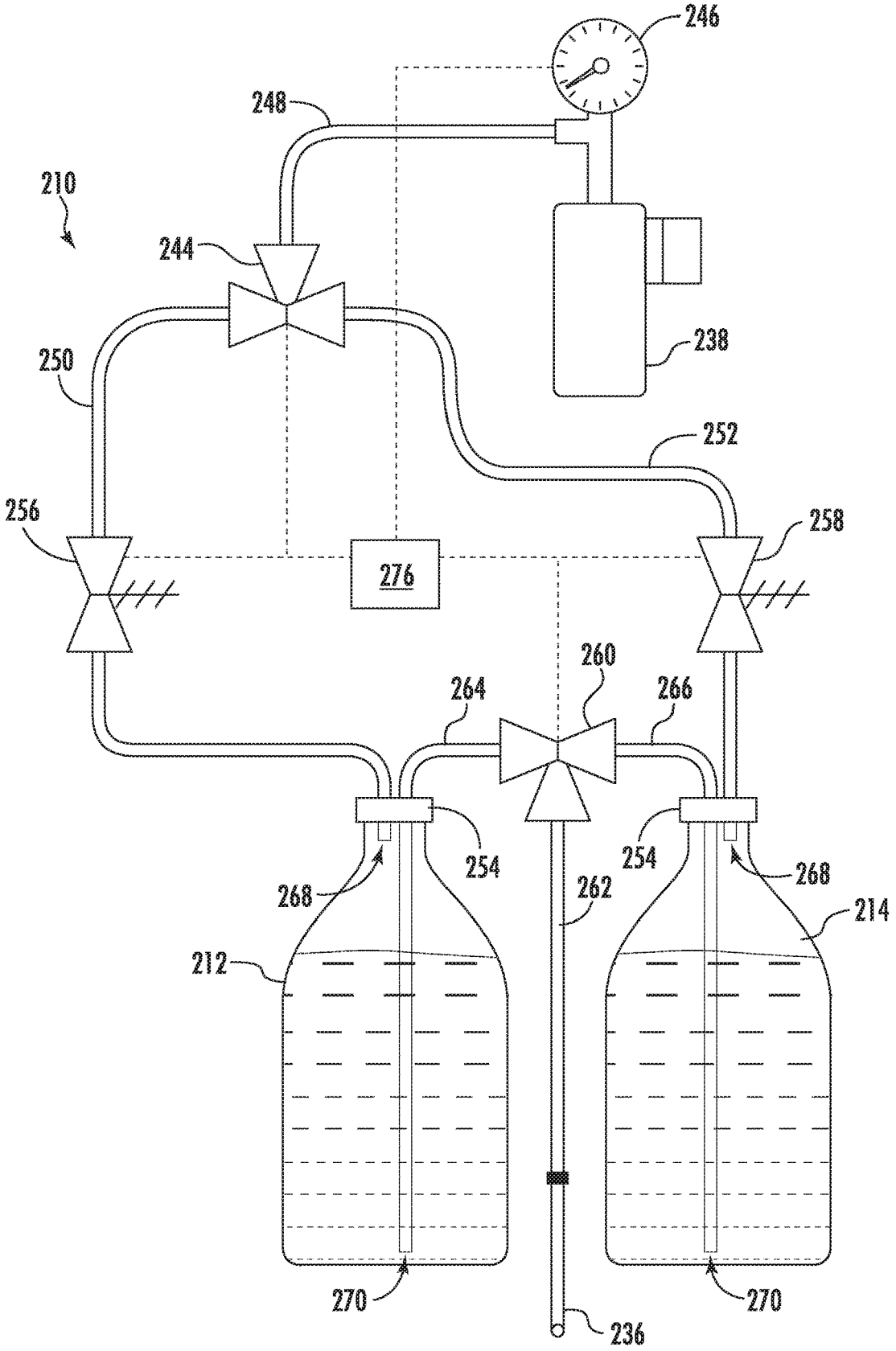
FIG. 7 provides a schematic view of a fluid system of a modular beverage-dispensing assembly according to exemplary embodiments of the present disclosure.

Turning now to the figures, FIGS. 1 and 2 provide perspective views of a refrigerator appliance (e.g., refrigerator appliance 100) according to exemplary embodiments of the present disclosure.

As shown, refrigerator appliance 100 includes a cabinet or housing 102 that extends between a top 104 and a bottom 106 along a vertical direction V; between a first side 108 and a second side 110 along a lateral direction L; and between a front 112 and a back 114 along a transverse direction T. Housing 102 defines one or more chilled chambers for receipt of food items for storage. In some embodiments, housing 102 defines fresh food chamber 122 positioned at or adjacent top 104 of housing 102 and a freezer chamber 124 arranged at or adjacent bottom 106 of housing 102.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

In some embodiments, various storage components are mounted within fresh food chamber 122 to facilitate storage of food items therein, as will be understood art. In particular, the storage components include storage bins 182, drawers 184, and shelves 186 that are mounted within fresh food chamber 122. Storage bins 182, drawers 184, and shelves 186 are configured for receipt of food items (e.g., beverages or solid food items) and may assist with organizing such food items. As an example, drawers 184 can receive fresh food items (e.g., vegetables, fruits, or cheeses) and increase the useful life of such fresh food items. Additionally or alternatively, one or more of the bins 182, drawers 184, and shelves 186 may be configured to receive a modular beverage-dispensing assembly 200, as will be described in greater detail below.

Generally, refrigerator appliance 100 may be referred to as a bottom mount refrigerator. It is recognized, however, that the benefits of the present disclosure apply are not limited to a certain type or configuration of refrigerator appliance and may be appreciated independent of any refrigerator appliance. Consequently, the description set forth herein is for illustrative purposes only and is not intended to be limiting in any aspect to any particular refrigerator appliance configuration.

Turning now to FIGS. 3 through 7, various views are provided of a modular beverage-dispensing assembly 200 according to exemplary embodiments of the present disclosure. Generally, modular beverage-dispensing assembly 200 includes a housing 202 that contains or supports a fluid system 210 for selectively dispensing multiple discrete beverages (e.g., consumable liquids, such as beer, soda, juice, coffee, tea, spirits, wine, etc.) stored within corresponding discrete beverage containers 212, 214. Housing 202 and fluid system 210 may be self-contained such that both may be moved or transported together (e.g., as a single unit) without the need to provide a tethered liquid source (e.g., municipal water source) or power source (e.g., municipal power grid).

As shown, housing 202 may be relatively small and sized, for instance, to rest on a single bin 182 of refrigerator appliance. Generally, housing 202 extends along a vertical direction V' between a top end 216 and a bottom end 218; along a lateral direction L' between a first side 220 and a second side 222; and along the transverse direction T' between a front end 224 and a rear end 226. Each of the vertical direction V', lateral direction L', and transverse direction T' are mutually-orthogonal to define an orthogonal orientation system. It is noted that although the housing 202 and cabinet 102 are both described in terms of vertical, lateral, and transverse directions, the direction systems need not be necessarily identical. Moreover, the housing 202 and cabinet 102 may freely move with respect to one another while maintaining the described features and relative (i.e., internally relative) orientations. Thus, direction systems may be parallel to each other (e.g., when beverage-dispensing assembly 200 is received within the fresh food chamber 122), but need not be (e.g., when beverage-dispensing assembly 200 is removed from door 128).

When assembled, housing 202 may selectively support one or more beverage containers 212, 214. For instance, housing 202 may include a front platform 228 that extends along the front end 224. In some embodiments, the front platform 228 generally defines a support surface 230 on which the containers 212, 214 may be placed. The support surface 230 may be any suitable shape on which the containers 212, 214 may rest, such as a planar surface or complementary surface defined as a negative shape to that of the bottom of each container 212 or 214. Optionally, the support surface 230 may be unrestricted (e.g., in the vertical direction V') such that each container 212 or 214 may be freely placed on or removed from front platform 228. Additionally or alternatively, a backstop wall 232 may extend from the front platform 228 (e.g., vertically from the bottom end 218 to the top end 216). Backstop wall 232 may be positioned or located rearward from the support surface 230. When supported on the housing 202, a side portion of the beverage containers 212, 214 may engage or contact backstop wall 232 (e.g., to prevent or hinder the beverage containers 212, 214 from tipping or falling over).

In certain embodiments, the head unit 234 of the housing 202 extends vertically from the front platform 228. For instance, the head unit 234 may extend from the bottom end 218 to a height that is below the top end 216. As shown, the head unit 234 may be located between portions of the support surface 230 between adjacent beverage containers 212, 214. Additionally or alternatively, the head unit 234 may extend along the transverse direction T' from backstop wall 232 (e.g., to the front end 224). During use, adjacent beverage containers 212, 214 (or portions of the support surface 230 on which adjacent beverage containers 212, 214 can be placed) may be separated (e.g., along the lateral direction L') by the head unit 234.

In some embodiments, one or more outlet nozzles 236 extend from the head unit 234 (e.g., in selective downstream fluid communication with the beverage containers 212, 214). For instance, an outlet nozzle 236 may extend as an arcuate gooseneck extending upwardly from the head unit 234 before being redirected forward and downward such that an opening of the outlet nozzle 236 faces the ground or the bottom end 218. Optionally, a single outlet nozzle 236 may be provided to selectively and separately dispense liquids from beverage containers 212, 214. In other words, the liquid contents of multiple beverage containers 212, 214 may be dispensed separate from each other through the single outlet nozzle 236. Alternatively, multiple discrete outlet nozzles (not pictured) may be provided to selectively and separately dispense liquids from beverage containers 212, 214. In other words, a separate outlet nozzle may correspond to each beverage container 212 and 214 such that the liquid contents of the beverage containers 212, 214 may be dispensed separate from each other through the separate outlet nozzles.

Separate from, or in addition to, front platform 228, housing 202 may support a compressed gas tank 238 that is selectively mounted to housing 202. For instance, compressed gas tank 238 may be mounted at a location that is rearward from the beverage containers 212, 214 or front platform 228. In certain embodiments, housing 202 includes a rear enclosure 240 that defines a cavity 241 in which the compressed gas tank 238 may be selectively placed. For instance, when assembled, the compressed gas tank 238 may be enclosed (e.g., at least in part) within the cavity 241. As shown, the rear enclosure 240 may be positioned or located rearward from the front platform 228. Specifically, the rear enclosure 240 may extend along the transverse direction T' from the backstop wall 232 to the rear end 226. Additionally or alternatively, the rear enclosure 240 may extend from the bottom end 218 to the top end 216. Optionally, a removable top wall 242 may be selectively placed over cavity 241 (e.g., to selectively cover the compressed gas tank 238).

Along with selectively enclosing the compressed gas tank 238, the rear enclosure 240 may hold or contain one or more valves (e.g., 244, 246, 256, 258, 260), conduits (e.g., 248, 250, 252, 262, 264, 266), or other components of the fluid system 210.

Generally, fluid system 210 provides compressed gas tank 238 in selective fluid communication with the beverage containers 212, 214 so that the contents of each container 212 or 214 (e.g., each beverage or liquid) can be separately dispensed from housing 202. In order to provide a motivating gas, compressed gas tank 238 may store any suitable inert gas for driving a liquid beverage, such as carbon dioxide, nitrogen, argon, etc.

In some embodiments, a multipath gas valve 244 is included in fluid communication with the compressed gas tank 238. Specifically, the multipath gas valve 244 is downstream from the compressed gas tank 238. In some embodiments, the multipath gas valve 244 may further be in selective fluid communication with the beverage containers 212, 214. For instance, relative to the fluid flow path of compressed gas, the multipath gas valve 244 may be located between the compressed gas tank 238 and the beverage containers 212, 214.

During use, multipath gas valve 244 may be selectively actuated or moved to alternately direct compressed gas to one of the beverage containers 212, 214 (e.g., a first beverage container 212 or a second beverage container 214). As an example, the multipath gas valve 244 may be a three-way valve that can move between at least a first position and a second position. In the first position, compressed gas may be permitted from the compressed gas tank 238 to the first beverage container 212, while being prevented from flowing to the second beverage container 214. In the second position, compressed gas may be permitted from the compressed gas tank 238 to the second beverage container 214, while being prevented from flowing to the first beverage container 212. Optionally, a third position may be provided wherein gas is restricted or otherwise prevented from flowing through the multipath gas valve 244 to either beverage containers 212, 214.

As shown, a pressure regulator 246 may be included with the fluid system 210. Specifically, the pressure regulator 246 may be provided in fluid communication between the compressed gas tank 238 and the multipath gas valve 244 to control the pressure of compressed gas to the multipath gas valve 244. Generally, the pressure regulator 246 may be provided as any suitable valve for selectively controlling the pressure of compressed gas directed to the multipath gas valve 244. When assembled, the pressure regulator 246 is selectively adjustable to vary the pressure upstream from the multipath gas valve 244. Advantageously, beverages or liquids of varying densities and viscosities may be pressurized to flow at similar or identical speeds (e.g., volumetric flow rates) from a common gas source (i.e., compressed gas tank 238).

One or more fluid conduits may extend between the compressed gas tank 238, multipath gas valve 244, and beverage containers 212, 214, as would be understood. For instance, a single gas conduit 248 (or multiple conduits connected in fluid series with each other) may extend between the compressed gas tank 238 or pressure regulator 246 and the multipath gas valve 244. In certain embodiments, parallel gas conduits 250, 252 (i.e., discrete conduits in fluid parallel to each other) extend between the multipath gas valve 244 and the beverage containers 212, 214 without exchanging gas between each other. Thus, a first parallel gas conduit 250 may extend from the multipath gas valve 244 to the first beverage container 212, while a second parallel gas conduit 252 extends from the multipath gas valve 244 to the second beverage container 214.

In some embodiments, each beverage container 212 or 214 is attached to a separate removable sealing lid 254 through which a corresponding gas conduit (e.g., 250 or 252) may pass. When attached, the sealing lid 254 closes an opening defined through, for instance, the top of the corresponding beverage container 212 or 214. Moreover, each sealing lid 254 generally seals off the beverage container 212 or 214 from the ambient environment such that fluid into and out of the beverage container 212 or 214 is controlled as part of the fluid system 210. Thus, various unique beverage containers 212, 214 may be connected to and removed from the fluid system 210.

In optional embodiments, a pressure-release valve 256 or 258 is positioned in fluid communication between the multipath gas valve 244 and one or more of the beverage containers 212, 214. For instance, a first pressure-release valve 256 may be provided along the fluid path defined by the first parallel gas conduit 250. Additionally or alternatively, a second pressure-release valve 258 may be provided along the fluid path defined by the second parallel gas conduit 252. Optionally, a discrete pressure-release valve 256 or 258 may be provided between the multipath gas valve 244 and each beverage container 212 or 214, as shown.

Generally, a pressure-release valve 256 or 258 may be selectively opened to vent (i.e., release gas) to the ambient environment. Thus, when opened, the pressure-release valve 256 or 258 may permit air to flow to the ambient environment instead of flowing through or remaining trapped within a portion of the gas flow path between the multipath gas valve 244 in the corresponding beverage container 212 or 214. By contrast, when closed, the flow of gas to the ambient environment (e.g., through the pressure-release valve 256 or 258) is restricted or otherwise prevented. During use, the pressure-release valve 256 or 258 may generally be open (e.g., continuously or temporarily) when the multipath gas valve 244 is closed or otherwise prevents the flow of compressed gas from the compressed gas tank 238 to the corresponding beverage container 212 or 214. As an example, when the multipath gas valve 244 is in the second position or third position, the first pressure-release valve 256 may be opened, allowing the first beverage container 212 to reach an equilibrium with the ambient environment. As another example, when the multipath gas valve 244 is in the first position or third position, the second pressure-release valve 258 may be opened, allowing the second beverage container 214 to reach an equilibrium with the ambient environment.

In certain embodiments, a multipath liquid valve 260 is included in fluid communication with each of the beverage containers 212, 214. Specifically, the multipath liquid valve 260 may be in selective downstream fluid communication with each of the beverage containers 212, 214 to alternately permit the liquid contents from the beverage containers 212, 214 through the multipath liquid valve 260. Optionally, and outlet nozzle 236 may be provided downstream from the multipath liquid valve 260 (e.g., to dispense the liquid contents from the beverage containers 212, 214 received from the multipath liquid valve 260)

During use, the multipath liquid valve 260 may be selectively actuated or moved to alternately direct liquid from one of the beverage containers 212, 214 (e.g., the first beverage container 212 or the second beverage container 214). As an example, multipath liquid valve 260 may be a three-way valve that can move between at least a first position and a second position. In the first position, liquid may be permitted from the first beverage container 212, while being prevented from the second beverage container 214. In the second position, liquid may be permitted from the second beverage container 214, while being prevented from flowing from the first beverage container 212. Optionally, a third position may be provided wherein liquid is restricted or otherwise prevented from flowing through the multipath liquid valve 260 (e.g., to the outlet nozzle 236) from either of the beverage containers 212, 214.

In certain embodiments, the positions of the multipath liquid valve 260 are associated with or generally correspond to the positions of multipath gas valve 244. For instance, the first position of the multipath liquid valve 260 may correspond to the first position of the multipath gas valve 244 while the second position of the multipath liquid valve 260 also corresponds to the second position of the multipath gas valve 244. The third position of the multipath liquid valve 260 may correspond to the third position of the multipath gas valve 244. Thus, in the first positions of the valves 244, 260; compressed gas may be permitted from the compressed gas tank 238 and into the first beverage container 212. The pressure of such gas may force the liquid contents of the first beverage container 212 through the multipath liquid valve 260 and to the outlet nozzle 236. Similarly, in the second positions of the valves 244, 260; compressed gases may be permitted from the compressed gas tank 238 and into the second beverage container 214. The pressure of such gas may force the liquid contents of the second beverage container 214 through the multipath liquid valve 260 and to the outlet nozzle 236.

One or more fluid conduits may extend between the beverage containers 212, 214, multipath liquid valve 260, and outlet nozzle 236, as would be understood. For instance, a single liquid conduit 262 (or multiple conduits connected in fluid series with each other) may extend between the multipath liquid valve 260 and the outlet nozzle 236. In certain embodiments, parallel liquid conduits 264, 266 (i.e., discrete conduits in fluid parallel to each other) extend between the beverage containers 212, 214 and the multipath liquid valve 260. Thus, a first parallel liquid conduit 264 may extend from the first beverage container 212 to the multipath liquid valve 260, while a second parallel liquid conduit 266 extends from the second beverage container 214 to the multipath liquid valve 260.

In some embodiments, a corresponding liquid conduit (e.g., 264 or 266) may pass through each sealing lid 254. Thus, a separate gas conduit 250 or 252 and liquid conduit 264 or 264 may extend through each sealing lid 254. In certain embodiments, within the corresponding beverage container 212 or 214, the terminal end 270 of each liquid conduit 264, 266 may be positioned lower than the terminal end 268 of each gas conduit 250, 252. As shown, when a liquid conduit 264 or 266 is received within a corresponding beverage container 212 or 214, the corresponding gas conduit 250 or 252 may stop proximal to the top of the beverage container 212 or 214, while the liquid conduit 264 or 266 stops proximal to the bottom of the beverage container 212 or 214. During use, the pressure generated by compressed gas through the gas conduit within the beverage container 212 or 214 may thus force the liquid contents of the beverage container 212 or 214 downward and into the corresponding liquid conduit 264 or 266.

In some embodiments, a control panel or user interface 272 is provided on or mounted to the housing 202 to direct commandments to one or more portions of fluid system 210. Generally, user interface 272 includes one or more inputs 274 (e.g., buttons, toggle switches, knobs, touch pads, etc.), which a user may select to initiate functions of the beverage-dispensing assembly 200 (e.g., the dispensing of liquid from a selected beverage container 212 or 214). Optionally, one or more display components 275 (e.g., LEDs, bulbs, screens, etc.) may be provided to present visual feedback to a user. In certain embodiments, user interface 272 represents a general purpose I/O ("GPIO") device or functional block.

As shown, user interface 272 may be mounted on the head unit 234 (e.g., adjacent to outlet nozzle 236). Nonetheless, it is understood that user interface 272 may be provided at any suitable location on housing 202.

Operation of modular beverage-dispensing assembly 200 may be generally controlled by a processing device or assembly controller 276. Assembly controller 276 may, for example, be operatively coupled to user interface 272 for user manipulation to select features and operations of beverage-dispensing assembly 200, such as dispensing operations. Assembly controller 276 can operate various components of beverage-dispensing assembly 200 to execute selected system cycles and features. In exemplary embodiments, assembly controller 276 is operably coupled (e.g., in electrical or wireless communication) with the multipath gas valve 244; pressure regulator 246; pressure-release valves 256, 258; or multipath liquid valve 260. Thus, assembly controller 276 can selectively activate and operate multipath gas valve 244; pressure regulator 246; pressure-release valves 256, 258; or multipath liquid valve 260 (e.g., based on signals received the user interface 272).

Assembly controller 276 may include a memory and microprocessor, such as a general or special purpose microprocessor operable to execute programming instructions or micro-control code associated with operation of assembly 200. The memory may represent random access memory such as DRAM, or read only memory such as ROM or FLASH. In one embodiment, the processor executes programming instructions stored in memory. The memory may be a separate component from the processor or may be included onboard within the processor. Alternatively, assembly controller 276 may be constructed without using a microprocessor (e.g., using a combination of discrete analog or digital logic circuitry; such as switches, amplifiers, integrators, comparators, flip-flops, AND gates, and the like) to perform control functionality instead of relying upon software. One or more portions of assembly 200 may be in communication with assembly controller 276 via one or more signal lines or shared communication busses. A battery pack (not pictured) may be mounted to housing 202 in electrical communication with controller 276 and other components to supply an electrical current thereto, as would be understood.

In optional embodiments, controller 276 is configured to initiate a dispensing operation to selectively dispense liquid from one of the beverage containers 212, 214. The operation may include receiving a beverage-selection signal from the use interface 272. Generally, the beverage-selection signal may indicate which beverage container (e.g., either the first beverage container 212 or the second beverage container 214) a user has chosen to dispense from. For instance, the beverage-selection signal may be received in response to a user pressing an input 274 at user interface 272 corresponding to one beverage container 212 or 214. Based on the received beverage-selection signal, the assembly controller 276 may actuate the multipath liquid valve 260. Specifically, the multipath liquid valve 260 may be opened (e.g., to the first position when the first beverage container 212 is selected) to define an exclusive flow path from one of the beverage containers 212, 214. Thus, only liquid from the selected beverage container 212 or 214 may be permitted through the multipath liquid valve 260.

Additionally or alternatively, the dispensing operation may include receiving a beverage-output signal from the user interface 272. Generally, the beverage-dispensing signal may indicate that the user desires the liquid from the selected beverage container 212 or 214 to be dispensed from the outlet nozzle 236. Based on the received beverage-output signal, the assembly controller 276 may actuate the multipath gas valve 244 (e.g., to the first position when the first beverage container 212 is selected) to open an exclusive flow path from the compressed gas tank 238 to one beverage container 212 or 214. Thus, compressed gas may be permitted through the multipath gas to only one beverage container 212 or 214. Optionally, the assembly controller 276 may actuate the multipath gas valve 244 to a fully-closed position (e.g., the third position, as described above) in the absence of a beverage-output signal. In such embodiments, dispensing or directing compressed gas to the beverage containers 212, 214 may be contingent on continuous engagement of a corresponding input 274.

In some embodiments, the beverage-selection signal is received from a separate input 274 of the user interface 272 from the beverage-output signal. In such embodiments, engaging (e.g., pressing) one input 274 indicates the beverage container 212 or 214 from which liquid may be dispensed, and engaging (e.g., pressing) another input 274 initiates dispensing from outlet nozzle 236. In alternative embodiments, the beverage-selection signal is received from the same input 274 of the user interface 272 as the beverage-output signal (e.g., simultaneously) In such embodiments, engaging (e.g., pressing) one input 274 both indicates the beverage container 212 or 214 from which liquid may be dispensed and initiates dispensing from outlet nozzle 236.

In optional embodiments, the dispensing operation includes determining a non-dispensing state subsequent to receiving the beverage-output signal. The non-dispensing state generally indicates no further dispensing of liquid from the outlet nozzle 236 is desired. As an example, the determination may be based on (e.g., in response to) the absence of the beverage-output signal. For instance, engagement of a dispensing input 274 may be ceased such that no beverage-dispensing signal is received. As an additional or alternative example, the determination may be based on expiration of a predetermined amount of time (i.e., a non-zero span of time, such as 1 to 5 seconds) following receiving the beverage-dispensing signal.

In response to determining the non-dispensing state, the assembly controller 276 may actuate a corresponding pressure-release valve 256 or 258 to open and establish a ventilation path between the pressure-release valve 256 or 258 and the ambient environment. The corresponding pressure-release valve 256 or 258 may specifically correspond to (e.g., be positioned upstream of) the beverage container 212 or 214 selected via the beverage-selection signal. Thus, actuating the pressure-release valve 256 or 258 may allow the selected beverage container 212 or 214 to reach an equilibrium with the ambient environment immediately once the initiated dispensing stops.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A modular beverage-dispensing assembly comprising:

a housing;

a compressed gas tank mounted to the housing;

a plurality of discrete beverage containers supported on the housing;

a multipath gas valve downstream from the compressed gas tank in selective upstream fluid communication with the plurality of discrete beverage containers to selectively direct a compressed gas from the compressed gas tank to one beverage container of the plurality of discrete beverage containers;

a pressure-release valve positioned in fluid communication between the multipath gas valve and the one beverage container of the plurality of discrete beverage containers;

a user interface attached to the housing; and an assembly controller operably coupled to the user interface and the pressure-release valve, the assembly controller being configured to initiate a dispensing operation comprising receiving a beverage-output signal from the user interface, determining a non-dispensing state subsequent to receiving the beverage-output signal, and actuating the pressure-release valve to open a ventilation path between the pressure-release valve and an ambient environment in response to determining the non-dispensing state.

2. The modular beverage-dispensing assembly of claim 1, wherein the housing comprises a front platform extending forward from the gas tank, the plurality of discrete beverage containers being supported on the front platform.

3. The modular beverage-dispensing assembly of claim 1, wherein the housing comprises a rear enclosure defining a cavity enclosing the compressed gas tank.

4. The modular beverage-dispensing assembly of claim 1, further comprising a multipath liquid valve in selective downstream fluid communication with each beverage container of the plurality of discrete beverage containers to selectively direct a liquid from the one beverage container of the plurality of discrete beverage containers.

5. The modular beverage-dispensing assembly of claim 4, further comprising an outlet nozzle downstream from the multipath liquid valve to dispense a liquid received therefrom.

6. The modular beverage-dispensing assembly of claim 4, wherein the assembly controller is operably coupled to the multipath liquid valve, and wherein the dispensing operation further comprises receiving a beverage-selection signal from the user interface, and actuating the multipath liquid valve to open an exclusive liquid flow path from the one beverage container of the plurality of discrete beverage containers, the actuating the multipath liquid valve being based on the received beverage-selection signal.

7. The modular beverage-dispensing assembly of claim 1, wherein the assembly controller is operably coupled to the multipath gas valve, and wherein the dispensing operation further comprises actuating the multipath gas valve to open an exclusive gas flow path from the compressed gas tank to the one beverage container of the plurality of discrete beverage containers, the actuating the multipath gas valve being based on the received beverage-output signal.

8. The modular beverage-dispensing assembly of claim 1, further comprising a pressure regulator in fluid communication between the compressed gas tank and the multipath gas valve, the pressure regulator being selectively adjustable to vary pressure upstream from the multipath gas valve.

9. A modular beverage-dispensing assembly comprising:

a housing;

a compressed gas tank mounted to the housing;

a plurality of discrete beverage containers supported on the housing;

a multipath liquid valve in selective downstream fluid communication with each beverage container of the plurality of discrete beverage containers to selectively direct a liquid from one beverage container of the plurality of discrete beverage containers;

an outlet nozzle downstream from the multipath liquid valve to dispense a liquid received therefrom;

a pressure-release valve positioned in fluid communication between the compressed gas tank and the one beverage container of the plurality of discrete beverage containers a user interface attached to the housing; and an assembly controller operably coupled to the user interface and the pressure-release valve, the assembly controller being configured to initiate a dispensing operation comprising receiving a beverage-output signal from the user interface, determining a non-dispensing state subsequent to receiving the beverage-output signal, and actuating the pressure-release valve to open a ventilation path between the pressure-release valve and an ambient environment in response to determining the non-dispensing state.

10. The modular beverage-dispensing assembly of claim 9, wherein the housing comprises a front platform extending forward from the gas tank, the plurality of discrete beverage containers being supported on the front platform.

11. The modular beverage-dispensing assembly of claim 9, wherein the housing comprises a rear enclosure defining a cavity enclosing the compressed gas tank.

12. The modular beverage-dispensing assembly of claim 9, wherein the assembly controller is operably coupled to the multipath liquid valve, and wherein the dispensing operation further comprises receiving a beverage-selection signal from the user interface, and actuating the multipath liquid valve to open an exclusive liquid flow path from the one beverage container of the plurality of discrete beverage containers, the actuating the multipath liquid valve being based on the received beverage-selection signal.

13. The modular beverage-dispensing assembly of claim 9, further comprising a multipath gas valve downstream from the compressed gas tank in selective upstream fluid communication with the plurality of discrete beverage containers, wherein the assembly controller is operably coupled to the multipath gas valve, and wherein the dispensing operation further comprises actuating the multipath gas valve to open an exclusive gas flow path from the compressed gas tank to the one beverage container of the plurality of discrete beverage containers, the actuating based on the received beverage-output signal.

14. The modular beverage-dispensing assembly of claim 13, further comprising a pressure regulator in fluid communication between the compressed gas tank and the multipath gas valve, the pressure regulator being selectively adjustable to vary pressure upstream from the multipath gas valve.

15. A refrigerator appliance comprising:

a cabinet defining a chilled chamber;

a door attached to the cabinet to selectively restrict access to the chilled chamber; and a modular beverage-dispensing assembly selectively received within the chilled chamber, the modular beverage-dispensing assembly comprising a housing, a compressed gas tank mounted to the housing, a plurality of discrete beverage containers supported on the housing a multipath gas valve downstream from the compressed gas tank in selective upstream fluid communication with the plurality of discrete beverage containers to selectively direct a compressed gas from the compressed gas tank to one beverage container of the plurality of discrete beverage containers;

a multipath liquid valve in selective downstream fluid communication with each beverage container of the plurality of discrete beverage containers to selectively direct a liquid from the one beverage container of the plurality of discrete beverage containers, an outlet nozzle downstream from the multipath liquid valve to dispense a liquid received therefrom, a pressure-release valve positioned in fluid communication between the multipath gas valve and the one beverage container of the plurality of discrete beverage containers, a user interface attached to the housing, and an assembly controller operably coupled to the user interface and the pressure-release valve, the assembly controller being configured to initiate a dispensing operation comprising receiving a beverage-output signal from the user interface, determining a non-dispensing state subsequent to receiving the beverage-output signal, and actuating the pressure-release valve to open a ventilation path between the pressure-release valve and an ambient environment in response to determining the non-dispensing state.

16. The refrigerator appliance of claim 15, wherein the housing comprises a front platform extending forward from the gas tank, the plurality of discrete beverage containers being supported on the front platform.

17. The refrigerator appliance of claim 15, wherein the housing comprises a rear enclosure defining a cavity enclosing the compressed gas tank.

18. The refrigerator appliance of claim 15, wherein the assembly controller is operably coupled to the multipath liquid valve, and wherein the dispensing operation further comprises receiving a beverage-selection signal from the user interface, and actuating the multipath liquid valve to open an exclusive liquid flow path from the one beverage container of the plurality of discrete beverage containers, the actuating the multipath liquid valve being based on the received beverage-selection signal.

19. The refrigerator appliance of claim 15, wherein the assembly controller is operably coupled to the multipath gas valve, and wherein the dispensing operation further comprises actuating the multipath gas valve to open an exclusive gas flow path from the compressed gas tank to the one beverage container of the plurality of discrete beverage containers, the actuating based on the received beverage-output signal.

20. The refrigerator appliance of claim 15, wherein the modular beverage-dispensing assembly further comprises a pressure regulator in fluid communication between the compressed gas tank and the multipath gas valve, the pressure regulator being selectively adjustable to vary pressure upstream from the multipath gas valve.

* * * * *